US007038117B2

(12) United States Patent
Yoshino

(10) Patent No.: US 7,038,117 B2
(45) Date of Patent: May 2, 2006

(54) ELECTRONIC PERCUSSION INSTRUMENT AND VIBRATION DETECTION APPARATUS

(75) Inventor: Kiyoshi Yoshino, Osaka (JP)

(73) Assignee: Roland Corporation, Osaka (JP)

( * ) Notice: Subject to any disclaimer, the term of this patent is extended or adjusted under 35 U.S.C. 154(b) by 180 days.

(21) Appl. No.: 10/733,587

(22) Filed: Dec. 11, 2003

(65) Prior Publication Data

US 2004/0118269 A1 Jun. 24, 2004

(30) Foreign Application Priority Data

Dec. 17, 2002 (JP) ..... 2002-365771

(51) Int. Cl.
*G10H 3/12* (2006.01)

(52) U.S. Cl. ..... 84/411 R; 84/723; 84/743

(58) Field of Classification Search ..... 84/411 R–421, 84/723, 743

See application file for complete search history.

(56) References Cited

U.S. PATENT DOCUMENTS

| | | | | |
|---|---|---|---|---|
| 729,936 | A | 6/1903 | Heybeck | |
| 4,168,646 | A * | 9/1979 | May | 84/723 |
| 4,242,937 | A * | 1/1981 | Pozar | 84/725 |
| 4,362,081 | A | 12/1982 | Hartry | |
| 4,714,002 | A | 12/1987 | Cleland | |
| 4,798,121 | A | 1/1989 | Donohoe | |
| 5,042,356 | A | 8/1991 | Karch | |
| 5,533,405 | A | 7/1996 | Hoshino | |
| 5,585,581 | A | 12/1996 | Rogers | |
| 5,633,473 | A | 5/1997 | Mori et al. | |
| 5,920,026 | A * | 7/1999 | Yoshino et al. | 84/738 |

FOREIGN PATENT DOCUMENTS

| | | |
|---|---|---|
| JP | 2-117569 | 9/1990 |
| JP | 10198375 | 7/1998 |

* cited by examiner

*Primary Examiner*—Marlon T. Fletcher
*Assistant Examiner*—David S. Warren
(74) *Attorney, Agent, or Firm*—Foley & Lardner LLP

(57) ABSTRACT

An electronic percussion instrument includes a vibration detection apparatus having a simplified frame structure that increases the uniformity of its rim shot strike sensitivity distribution. The frame is comprised of a flange, a center section and a linking section that surrounds the center section and extends from the center section to the flange. The flange engages the end of the drum body and the frame is disposed within the drum body. A rim shot sensor is mounted to the center section of the frame and detects rim shot vibrations that are transmitted through the frame. Because the linking section of the frame surrounds the center section, uniformity of rim shot strike sensitivity is improved. A head sensor is also mounted to the frame on a support plate that is coupled to the frame through a vibration isolating damper. A cushioning material is placed between the head sensor and a head of the percussion instrument for transmitting vibrations from the head to the head sensor. The flange of the frame and a drum head are held between an end of the drum body and a rim that is bolted to the drum body.

29 Claims, 9 Drawing Sheets

ELECTRONIC PERCUSSION INSTRUMENT AND VIBRATION DETECTION APPARATUS

RELATED APPLICATIONS

This application claims priority under 35 USC § 119(a) from Japanese patent application 2002-365771, filed 17 Dec. 2002, the entirety of which is incorporated herein by reference.

BACKGROUND OF THE INVENTION

1. Field of the Invention

Embodiments of the invention relate electronic percussion instruments and vibration detection apparatuses. More particularly, embodiments of the invention relate to electronic percussion instruments and vibration detection apparatuses having a simplified frame structure with a highly uniform sensitivity distribution.

2. Related Technology

Electronic percussion instruments such as electronic drums have sensors for detecting vibrations caused by striking of the drum. Electronic drums may be configured to control a musical tone in response to detected striking.

Acoustic drums may be struck in several different manners to produce different sounds. A conventional drum sound is produced by striking the drumhead. Another type of sound, referred to as a rim shot, is produced by striking the rim of the drum. Two types of rim shots are possible. In an open rim shot, the rim and the drumhead are struck simultaneously, producing a characteristic drum overtone effect. In a closed rim shot only the rim is struck, producing a clattering percussive sound.

A goal of electronic percussion instruments has been to enable both conventional head strikes and rim shots. Japanese Unexamined Patent Application Publication (Kokai) Number Hei 10-20854, which corresponds to U.S. Pat. No. 5,920,026, discloses an electronic drum that is furnished with a head arranged on a hollow body section. A first sensor detects vibrations produced by striking of the head, and a second sensor detects vibrations produced by striking of the rim. The signals from these two sensors make it possible to reproduce both types of rim shots.

A structure for attaching head and rim sensors to an electronic drum is disclosed in Japanese Unexamined Patent Application Publication (Kokai) Number Hei 10-198375. In this structure, a sensor frame having an approximately U-shaped cross section is arranged inside a hollow drum body to extend between the sides of the drum body. A rim shot sensor is arranged at the center of the drum at a lower portion of the frame. The location of the rim shot sensor at the center of the drum allows vibrations transmitted from the drum body to the rim shot sensor through the sensor frame to be detected with reasonable certainty. A head sensor is also arranged at the center of the drum on the sensor frame. The head sensor is arranged on a vibration isolating damper in direct contact with the head, allowing head strikes to be detected while rim shot strikes are suppressed.

The aforementioned structure is complicated in that the sensor frame is provided as a single elongated member that is affixed at its ends to the inside of the body section using screws. Fabrication is therefore complicated by the need to form holes in the drum body for attaching the sensor frame, and the number of parts needed to form the attachment.

In addition, because the sensor frame is provided as a single elongated structure, the sensor frame only makes contact with the drum body at two opposing points at its periphery, and so the quality of the vibrations that are transmitted from the rim through the sensor frame to the rim shot sensor changes depending on the location of the rim strike. Consequently, the rim shot strike sensitivity distribution of the drum is uneven, causing an impairment of performance characteristics.

SUMMARY OF THE INVENTION

In accordance with embodiments of the invention, a vibration detection apparatus for an electronic percussion instrument has a simplified frame structure that increases the uniformity of the rim shot strike sensitivity distribution. The frame is comprised of a circular flange for engaging the top end of a drum body. A linking section that surrounds a center section of the frame extends from the center section to the flange. A rim shot sensor or a head sensor may be provided at the center section.

In accordance with one embodiment, a vibration detection apparatus for an electronic percussion instrument is comprised of a frame and a rim shot sensor arranged on the frame. The frame comprises an outer peripheral section for engaging an end of a body of the electronic percussion instrument, a center section arranged at the approximate center of the outer peripheral section, and a linking section surrounding the center section and extending from the center section to the outer peripheral rim to link the center section with the outer peripheral rim. The rim shot sensor is arranged at the center section of the frame for detecting vibrations of the frame. When the rim of the electronic percussion instrument is struck, the resulting vibrations are transmitted through the outer peripheral section of the frame and through the linking section of the frame to the center section, where they are detected by the rim shot sensor. The center section is arranged at approximately the center of the outer peripheral section and is linked to the outer peripheral section by the radially extending arms of the linking section. Therefore, rim shot strikes occurring at any location of the outer peripheral section are transmitted roughly uniformly to the center section through the linking section, and so the rim shot strike sensitivity distribution is nearly uniform. The linking section may be comprised of arms having a U-shaped cross-section and may have openings in the arms and openings between the arms. In addition, the arms may be provided at roughly equal intervals around the frame.

In accordance with another embodiment, a vibration detection apparatus for an electronic percussion instrument for detecting vibrations caused by striking of the electronic percussion instrument is comprised of a frame, a head sensor supported by the frame at an approximate center of the frame, and a cushioning material arranged above the head sensor for engaging a head of the electronic percussion instrument to transmit vibrations of the head to the head sensor. The frame comprises an outer peripheral section for engaging an end of a body of the electronic percussion instrument, a center section arranged at the approximate center of the outer peripheral section, and a linking section surrounding the center section and extending from the center section to the outer peripheral rim to link the center section with the outer peripheral rim. When the head is struck, vibrations from the head are transmitted through the cushioning material to the head sensor. The cushioning material may be formed in a cylindrical shape or in another shape. The head sensor is preferably supported on the frame by a vibration buffering material, such as a vibration isolating damper or the like, to prevent vibrations of the frame from being detected by the head sensor. The linking section may be comprised of arms having a U-shaped cross-section and may have openings in the arms and openings between the arms. In addition, the arms may be provided at roughly equal intervals around the frame.

In accordance with another embodiment, an electronic percussion instrument is comprised of a hollow cylindrical body. A frame is arranged within the body. The frame is comprised of an outer peripheral section for engaging an end of a body of the electronic percussion instrument, a center section arranged at the approximate center of the outer peripheral section, and a linking section surrounding the center section and extending from the center section to the outer peripheral rim to link the center section with the outer peripheral rim. A rim shot sensor is arranged in the center section of the frame for detecting the vibrations of the frame. A head is arranged at the end portion of the body as a striking surface, a head sensor is supported by the frame at an approximate center of the frame, and a cushioning material is arranged between the head and the head sensor for transmitting vibrations of the head to the head sensor. A rim engages the body to hold the outer peripheral section of the frame and the head between the rim and the end portion of the body and to impart tension to the head. When the rim is struck, the vibrations due to the striking of the rim are transmitted through the outer peripheral section of the frame and the linking section to the center section where they are detected by the rim shot sensor. The center section is arranged at approximately the center of the outer peripheral section and is linked to the outer peripheral section by the linking section. Therefore, rim shot strikes occurring at any location of the outer peripheral section are transmitted roughly uniformly to the center section through the linking section, and so the rim shot strike sensitivity distribution is nearly uniform. When the head is struck, vibrations from the head are transmitted through the cushioning material to the head sensor. The cushioning material may be formed in a cylindrical shape or in another shape. The head sensor is preferably supported on the frame by a vibration buffering material, such as a vibration isolating damper or the like, to prevent vibrations of the frame from being detected by the head sensor. The linking section may be comprised of arms having a U-shaped cross-section and may have openings in the arms and openings between the arms. In addition, the arms may be provided at roughly equal intervals around the frame.

DETAILED DESCRIPTION OF PREFERRED EMBODIMENTS

Figure 1:
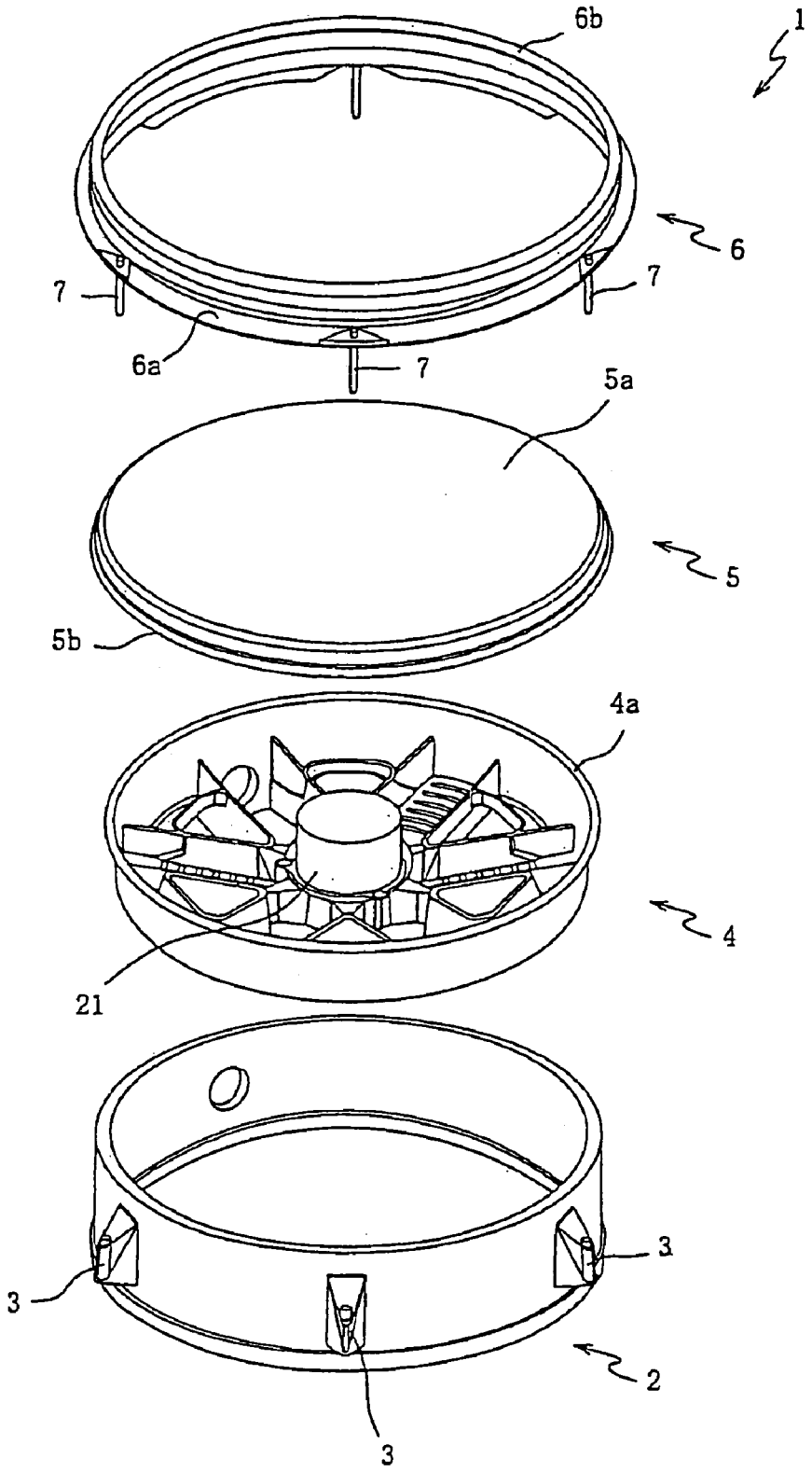
FIG. 1 is an exploded oblique view of an electronic percussion instrument in accordance with a first preferred embodiment of the invention.

A preferred embodiment and various alternatives are now described with reference to the Figures. FIG. 1 is an exploded oblique view of an electronic percussion instrument 1 in accordance with a preferred embodiment of the invention. The electronic percussion instrument 1 may be used to control a musical tone system (not shown) by striking the electronic percussion instrument with sticks or the like. Sensors for detecting the vibrations caused by strikes produce signals that control the production of musical tones. The musical tones are emitted from a speaker system through an amplifying system.

The electronic percussion instrument 1 of the preferred embodiment is furnished with the rim shot sensor 31 (see FIG. 4) that detects the striking of the rim 6, and a head sensor 21 that detects the striking of the head 5, allowing performances that employ rim shots.

The electronic percussion instrument 1 is furnished with a body section 2, a sensor frame 4, a head 5, and a rim 6, which are assembled by superimposing these several members as shown and screwing the rim 6 to the body section 2.

The body section 2 comprises the skeleton of the electronic percussion instrument 1 and, as is shown in FIG. 1, is formed in a roughly hollow cylindrical shape from, for example, a wooden material or a resin material. The sensor frame 4, which is discussed in detail below, is accommodated within the body section, and the head 5 and the rim 6 at the upper end of the body section 2. The body section 2 also includes a plurality of retaining sections 3 disposed around its outer surface at approximately equal intervals. The outer ends of the retaining sections 3 have female screw threads for receiving male screw threads of retaining bolts 7 provided on the rim 6, enabling the rim 6 to be screwed and fixed to the body section 2. The equal spacing of the retaining sections 3 allows the rim 6 to be screwed and fixed uniformly in the peripheral direction without offsetting the rim 6.

The sensor frame 4 transmits vibrations produced by striking of the rim 6 to the rim shot sensor 31. The sensor frame 4 has an essentially round container shape when viewed from the top. The head sensor 21 is disposed at approximately the center of the sensor frame 4, and the rim shot sensor 31 is disposed below the head sensor 21 at approximately the center of the sensor frame 4.

The sensor frame 4 has an outwardly extending flange section 4*a* at its top. The flange 4*a* is configured to engage the upper peripheral edge of the body section 2. When the instrument is assembled, the flange 4*a* is held between the rim 6 and the body section 2 along with the head 5. Therefore it is not necessary to use screws to attach the sensor frame, allowing assembly work to be simplified and attachment costs to be reduced. In addition, since it is not necessary to provide screw threads for fixing the sensor frame to the body section 2, the sensor frame may be manufactured as a single molded structure using an injection molding system or a casting system. This reduces the material costs and manufacturing costs of the sensor frame 4 while also enhancing its rigidity and strength.

There are no particular restrictions with regard to the material of the sensor frame 4, but the use of a hard plastic material or alloy material for die-casting is desirable. Examples include plastics such as polypropylene, polystyrene resin, hard vinyl chloride resin, ABS resin, acrylic resin, FRP resin, and polycarbonate, and alloys such as aluminum alloys, zinc alloys, magnesium alloys and copper alloys.

The head 5 is configured as a striking surface to be struck by a stick or the like. The head 5 includes a striking member 5*a* that is formed of a film material comprised of a reticular material knit from a synthetic fiber or a synthetic resin. The striking member 5*a* is adhered to a frame 5*b* that has a roughly toroidal shape as viewed from the front and is formed of a metal material or the like. When the electronic percussion instrument 1 is assembled, the head sensor 21 is arranged in contact with the striking member 5*a*, such that vibrations of the striking member 5*a* due to striking are detected by the head sensor 21.

The rim 6 holds and fixes the sensor frame 4 and the head 5 between the rim 6 and the body section 2. The rim 6 surrounds the outer periphery of the head 5 and imparts tension to the head 5. The rim 6 is provided with a plurality of retaining bolts 7 that are free to rotate within a metal rim fitting 6*a*, which is roughly toroidal in shape and formed from a metal material or the like.

The retaining bolts 7 screw and attach the rim 6 to the body section 2 and are arranged at roughly equal intervals around the periphery of the metal rim fitting 6a corresponding to the retaining sections 3 disposed on the body section 2. The retaining bolts 7 are screwed into the retaining sections 3 to fix the sensor frame 4 between the rim 6 and the body section 2. In this manner, a transmission path is formed from the rim 6 to the rim shot sensor 31 for vibrations produced by a rim shot.

A cover member 6*b* comprising an elastic material such as rubber covers the upper peripheral edge of the metal rim fitting 6*a*. The cover member reduces the amount of actual sound produced when the rim is struck.

During assembly of the electronic percussion instrument 1, the sensor frame 4 is inserted into the top of the body section 2, and the flange section 4*a* is engaged by the upper peripheral edge of the body section 2. The head 5 and the rim 6 are then placed on top of the sensor frame 4 and the retaining bolts 7 of the rim 6 are screwed into the retaining sections 3 of the body section 2. The flange 4*a* of the sensor frame 4 is held between the body section 2 and the rim 6 along with the head 5. Since this arrangement holds the flange in place firmly, there is no need to affix the sensor frame 4 to the inside of the body section 2 using attachment screws or the like. Consequently, it is possible to assemble the electronic percussion instrument 1 by means of extremely simple work.

Figure 2:
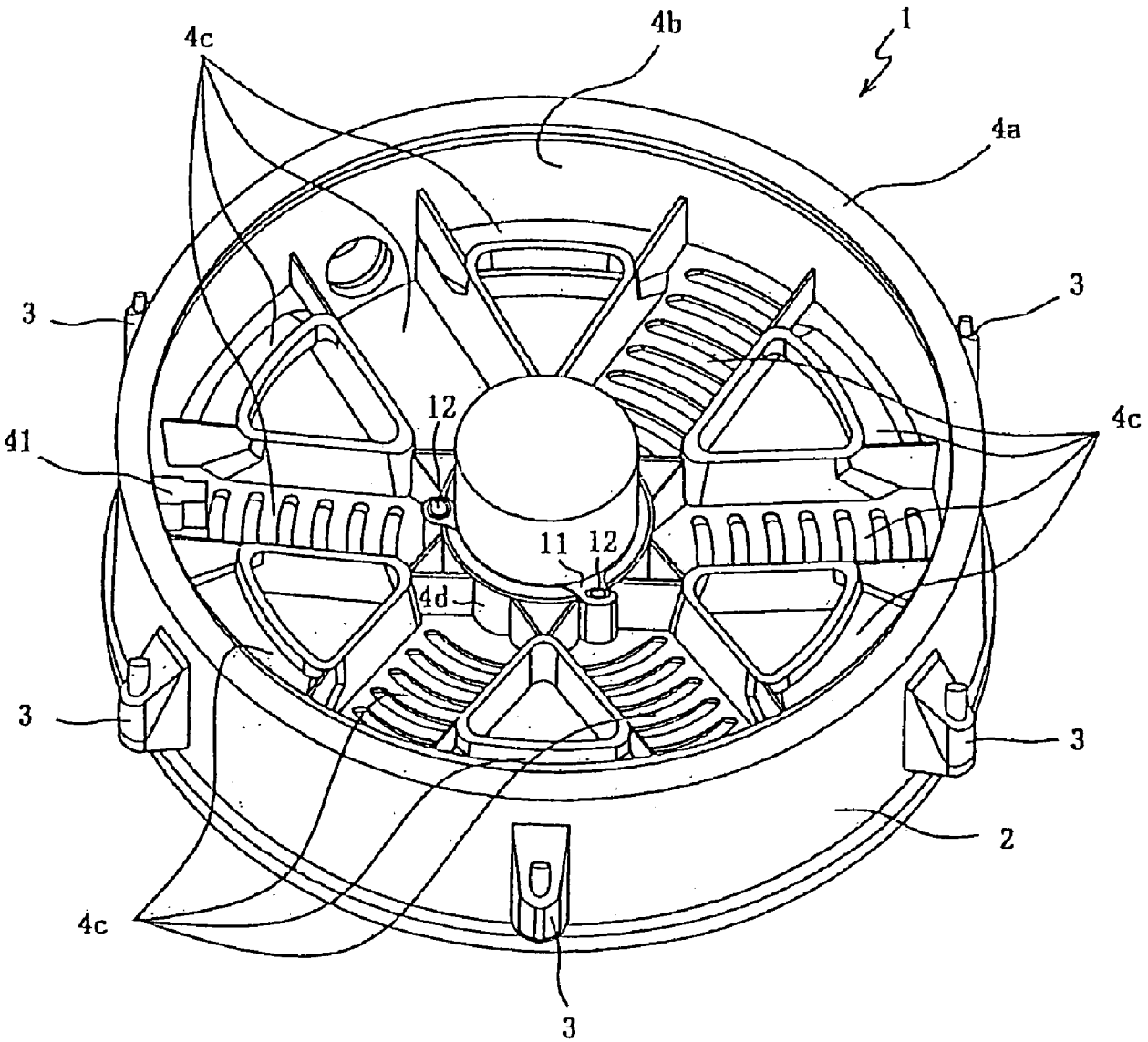
FIG. 2 is an oblique view of the electronic percussion instrument of the first preferred embodiment.
Figure 3:
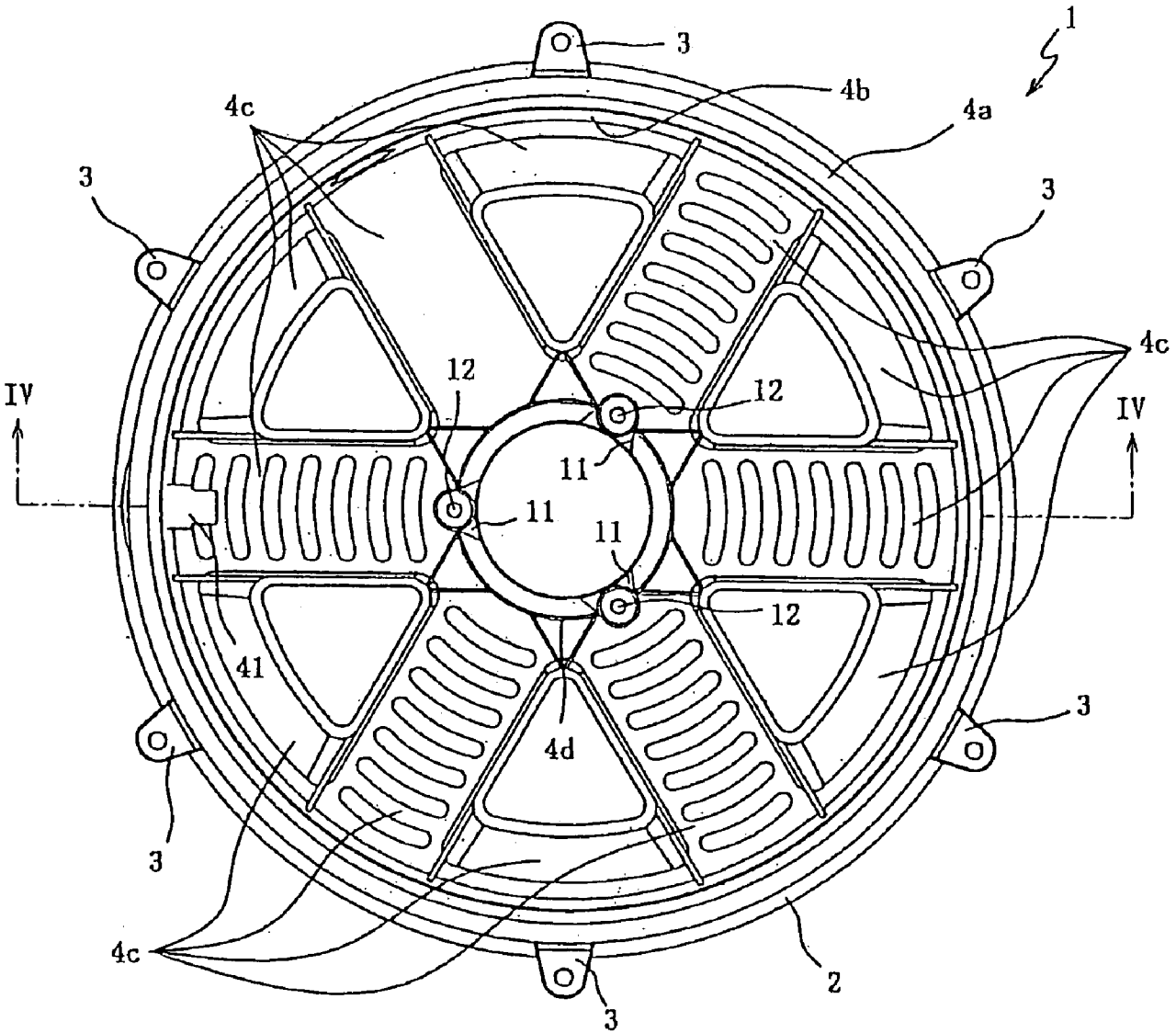
FIG. 3 is a front view of the electronic percussion instrument of the first preferred embodiment.

An explanation of the detailed configuration of the sensor frame 4 is now provided with reference to FIG. 2 and FIG. 3. FIG. 2 is an oblique view of the electronic percussion instrument 1 and FIG. 3 is a front view of the electronic percussion instrument 1. Certain features have been simplified in FIG. 2 and FIG. 3 in order to facilitate understanding of the preferred embodiment, and the depiction of the head 5 and the rim 6 as well as the depiction of the cables that electrically connect the output signal jack 41 to the head sensor 21 or the like have been omitted.

The sensor frame 4 is primarily comprised of the flange section 4*a*, the outer wall section 4*b*, the linking section 4*c*, and the center section 4*d*, which are preferably formed as a single integral structure having a roughly round container shape having an open top.

The flange 4*a* is engaged by the upper peripheral edge of the body section 2. The flange 4*a* is configured to contact the upper peripheral edge of the body section 2 approximately uniformly around its entire periphery. Therefore, a rim shot struck at any location around the rim produces essentially uniform transmission of vibrations from the rim 6 through the sensor frame 4 to the rim shot sensor 31. Variations in the strike sensitivity of the rim shot sensor 31 are therefore relatively small and, as a result, an improvement in rim shot performance is achieved.

The sidewall section 4*b* extends downward from the flange 4*a* and has a roughly hollow cylindrical shape with an outside diameter that is somewhat smaller than the inside diameter of the body section 2. The head sensor 21 and the rim shot sensor 31 are attached to the center section 4d disposed at approximately the center position of the sensor frame 4. A support plate 11 is screwed by an attachment screw 12 to the center section 4d and the head sensor 21 is disposed on the support plate 11. A vibration isolating damper 13 is interposed between the support plate 11 and the center section 4*d*. Rim shot vibrations transmitted to the sensor frame 4 are absorbed by the vibration isolating damper 13 before they reach the support plate 11, thus reducing the likelihood that rim shots are detected by the head sensor 21.

A linking section 4*c* surrounds the center section 4*d* and links the center section 4*d* to the inner peripheral surface of the outer peripheral section as shown in FIG. 3. In the preferred embodiment the linking section is comprised of arms that extend between the center section and the outer peripheral section, forming roughly triangular shaped openings between the arms. The arms are arranged around the center section at approximately equal intervals and the openings between the arms are arranged at approximately equal intervals. The arms and openings are formed in an approximately rotating symmetrical arrangement having the center section 4*d* as its center. This structure transmits vibrations from the flange 4*a* and the outer wall section 4*b* produced by rim shots approximately uniformly to the center section 4*d* and. Therefore variations in the strike sensitivity of the rim shot sensor 31 at the center section 4*d* are relatively small, thus improving the rim shot performance characteristics.

In addition, the arms have an essentially U-shaped cross-section as shown in FIG. 2. The U-shaped cross-section increases the rigidity and strength of the sensor frame 4, improving the vibration transmitting efficiency of the sensor frame 4. Therefore, even a small vibration from a light strike can be transmitted with high efficiency to the rim shot sensor 31 without being attenuated, improving rim shot performance characteristics through increased vibration detection sensitivity.

In addition, as is shown in FIG. 2 and FIG. 3, a plurality of slit shaped openings are formed in each arm. These slit shaped openings, together with the triangular shaped openings between the arms, reduce the resonance of the instrument and thus reduce reverberation when the head 5 is struck, causing the strike to make less sound. This reduces the striking noise heard by the performer.

The linking section 4*c* does not extend above the flange 4*a*, thereby providing a vacant space between the linking section 4*c* the head 5. This prevents the head 5 from contacting the sensor frame 4 when the head is struck and thus prevents interference during performance.

Figure 4:
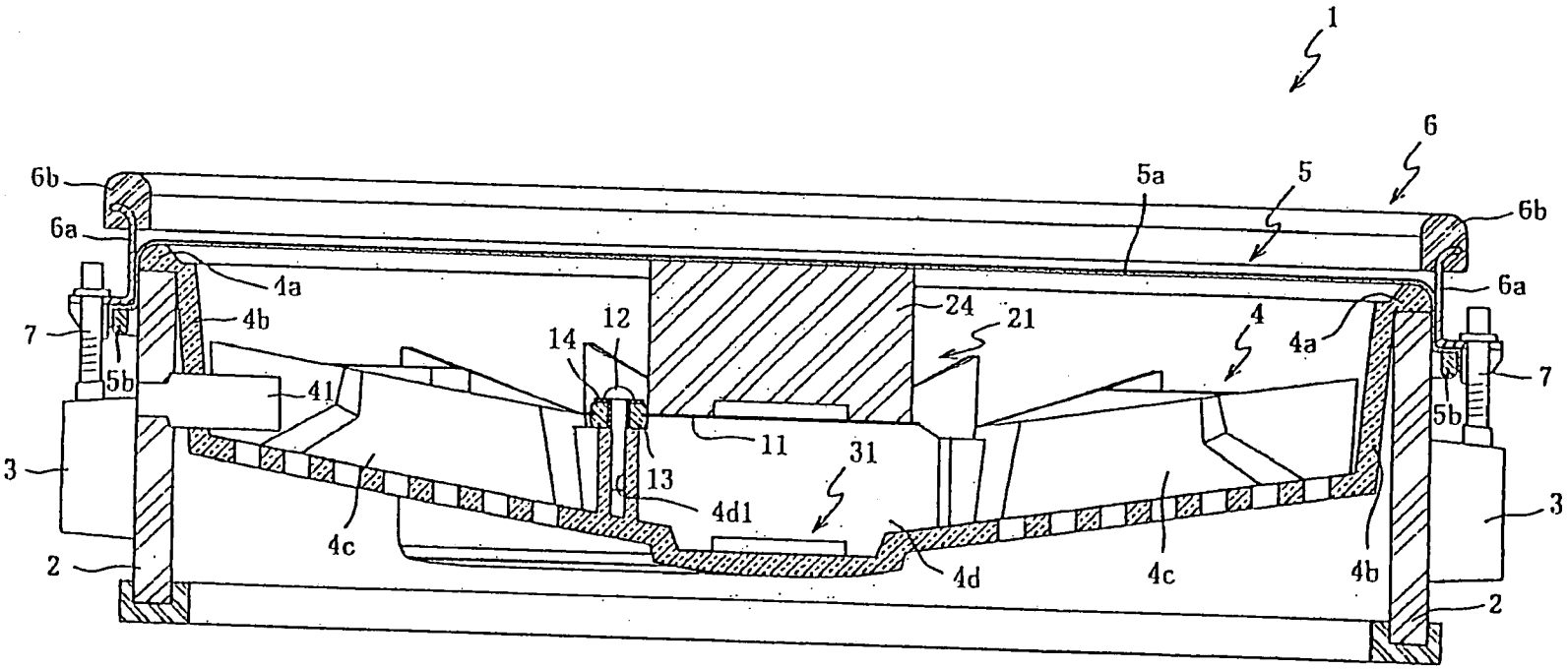
FIG. 4 is a cross-section drawing of the electronic percussion instrument of the first preferred embodiment along line IV—IV of FIG. 3.

The assembly of the sensor frame 4 to the electronic percussion instrument 1 and the attachment of the head sensor 21 and the rim shot sensor 31 to the sensor frame 4 are now discussed with reference to FIG. 4. FIG. 4 shows a cross-section of the electronic percussion instrument 1 along the line IV—IV of FIG. 3. It is noted that the head 5 and the rim 6 are omitted in FIG. 3 but are depicted in FIG. 4. The cables that electrically connect the output signal jack 41 and the head sensor 21 or the like are also omitted from FIG. 4.

The head 5 is comprised of the striking member 5*a* and the frame 5*b*, which has a roughly toroidal shape. As shown in FIG. 4, by fitting the frame 5*b* over the outer periphery of the body section 2, the striking member 5*a* is stretched and affixed to the upper surface of the body section 2 as a striking surface. The head sensor 21 is in contact with the bottom surface of the striking member 5*a*. Since the striking surface is configured using a striking member 5*a* comprised of a reticular material, the air resistance of the striking surface is reduced, and a satisfactory striking feeling is obtained when the striking surface is struck with a stick or the like and. In addition, the striking sound is reduced, enabling the performer to hear only the musical tones from the speaker system.

Further, since the vibrations of the striking member 5*a* are propagated only within the striking member 5*a*, there is virtually no effect by these vibrations on the body section 2, and therefore the vibrations of the striking member 5*a* are only detected by the head sensor 21 and there is no erroneous detection by the rim shot sensor 31.

The rim 6 is furnished with the metal rim fitting 6*a*, which is formed in a roughly toroidal shape and is provided with a plurality of retaining bolts 7 that are free to rotate. A cover member 6*b* is mounted to the rim fitting 6*a*, which in turn is mounted on the top surface side of the body section 2 by screwing the retaining bolts 7 into the retaining sections 3. In detail, the metal rim fitting 6*a* has a roughly L-shaped cross-section. The cover member 6*b* covers the top portion of the rim fitting 6*a*, and the rim fitting 6*a* covers the body section 2. The metal rim fitting 6*a* has its lower surface in contact with the head 5. In addition, the upper surface of the edge section is anchored by the anchoring protrusions that are disposed on the outer peripheries of the retaining bolts 7. When the retaining bolts 7 attached to the edge section of the metal rim fitting 6*a* are screwed into the retaining sections 3 of the body section 2, the metal rim fitting 6*a* has its edge section pressed down in the direction of the screwing by the anchoring protrusions of the retaining bolts 7, and the head 5 is thereby pressed downward through the edge section of the metal rim fitting 6*a*.

Since the striking member 5*a* of the head 5 is restricted in its movement downward by the flange section 4*a* of the sensor frame 4, it is stretched and affixed with a prescribed tension. As a result, the striking member 5*a* forms a striking surface on the upper surface of the body section 2. In addition, since the flange section 4*a* of the sensor frame 4 is pushed toward the upper peripheral edge of the body section 2 by the tension of the striking member 5*a*, the sensor frame is fixed strongly without rattling in the body section 2. The tension of the striking member 5*a* can be adjusted as desired in conformance with the preferences of the performer and the performance method by tightening or loosening the retaining bolts 7.

The sensor frame 4 has a container form having its upper surface open. When the flange section 4*a* that is formed on the upper edge of the sensor frame is engaged by the upper peripheral edge of the body section 2, the flange section 4 is held between the body section 2 and the rim 6 along with the head 5, and in this manner the sensor frame is attached inside the body section 2. As shown in FIG. 4, the head sensor 21 and the rim shot sensor 31 are respectively attached to the center section 4*d* of the sensor frame 4.

Figure 5:
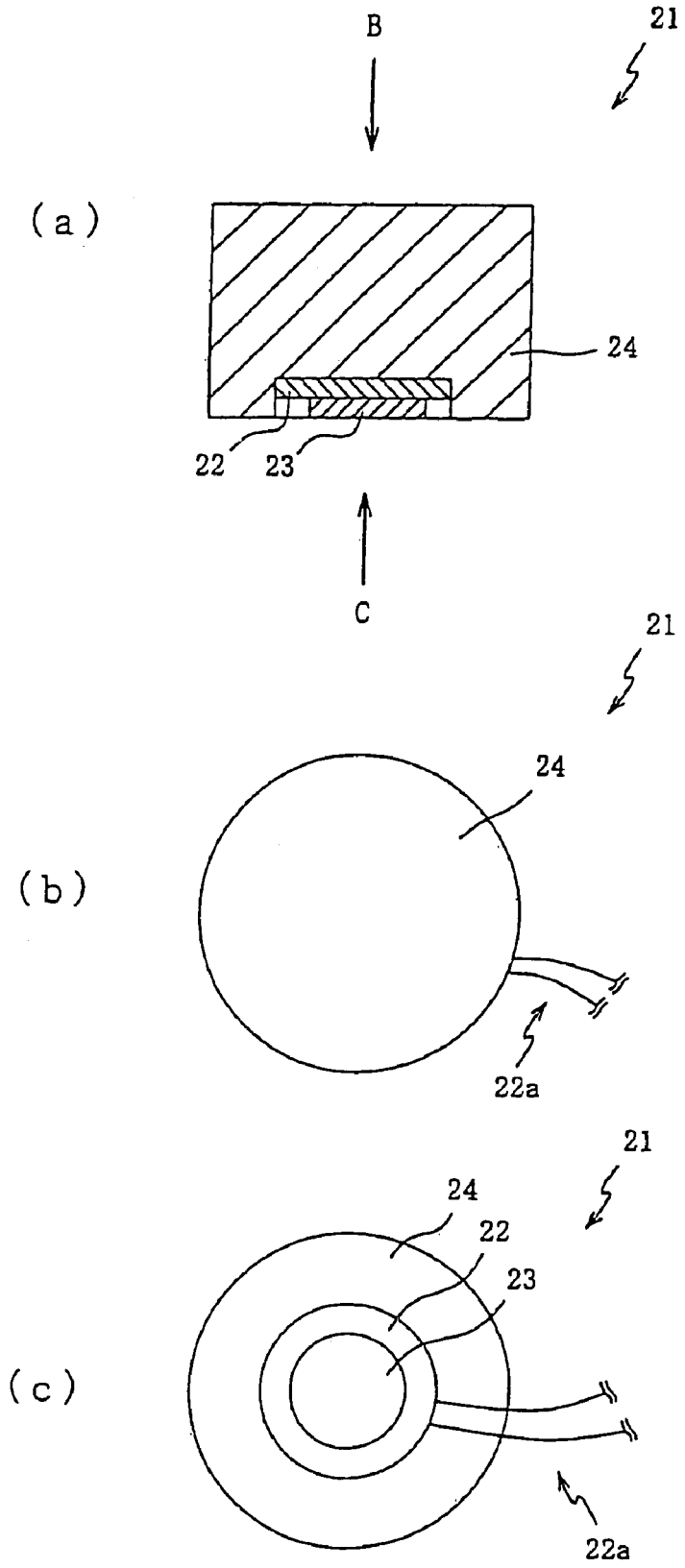
FIG. 5*a* is a lateral surface drawing of a head sensor.
FIG. 5*b* is an upper surface drawing of a head sensor and FIG. 5*c* is a lower surface drawing of a head sensor.
Figure 6:
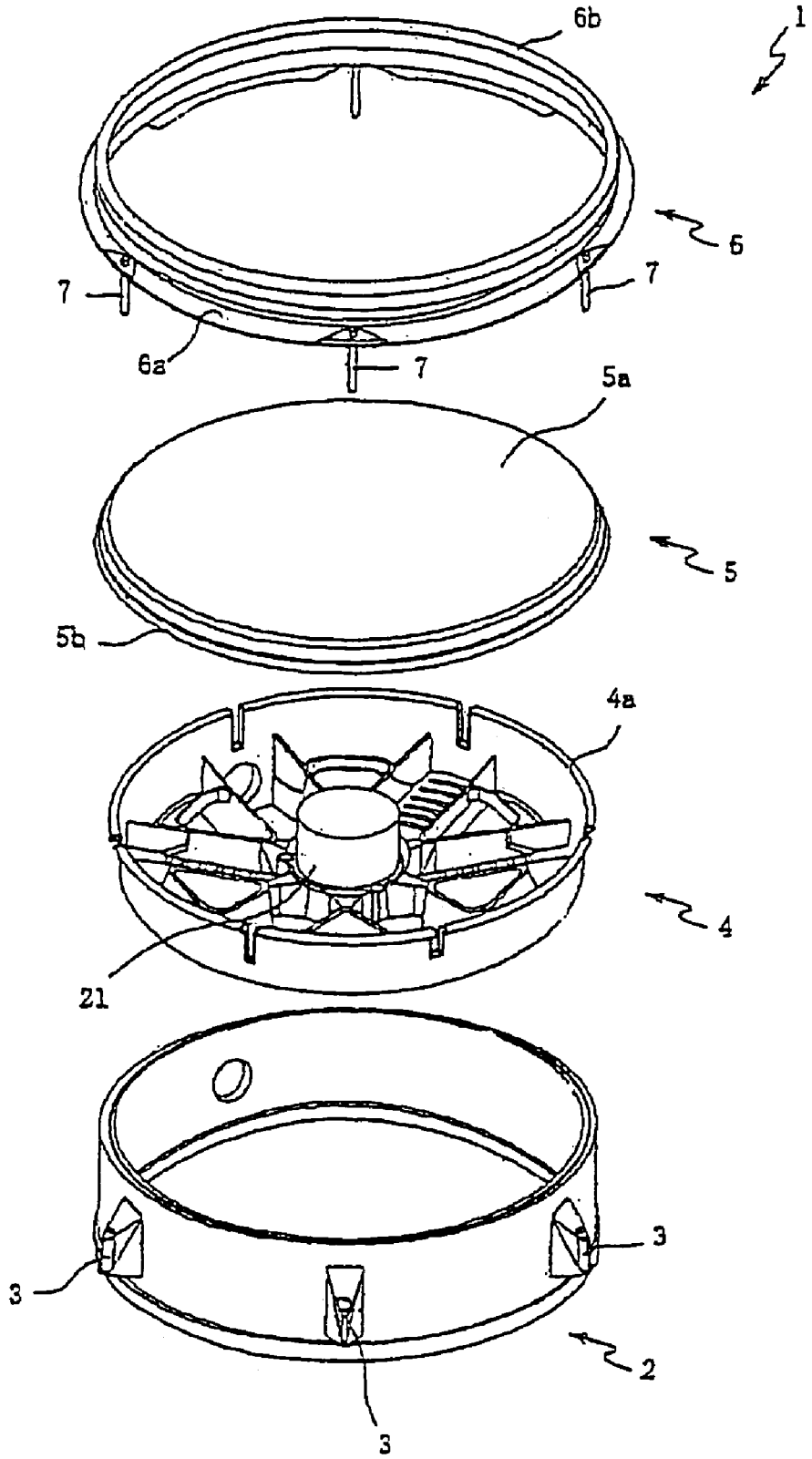
FIG. 6 is an exploded oblique view of an electronic percussion instrument in accordance with a second preferred embodiment.
Figure 7:
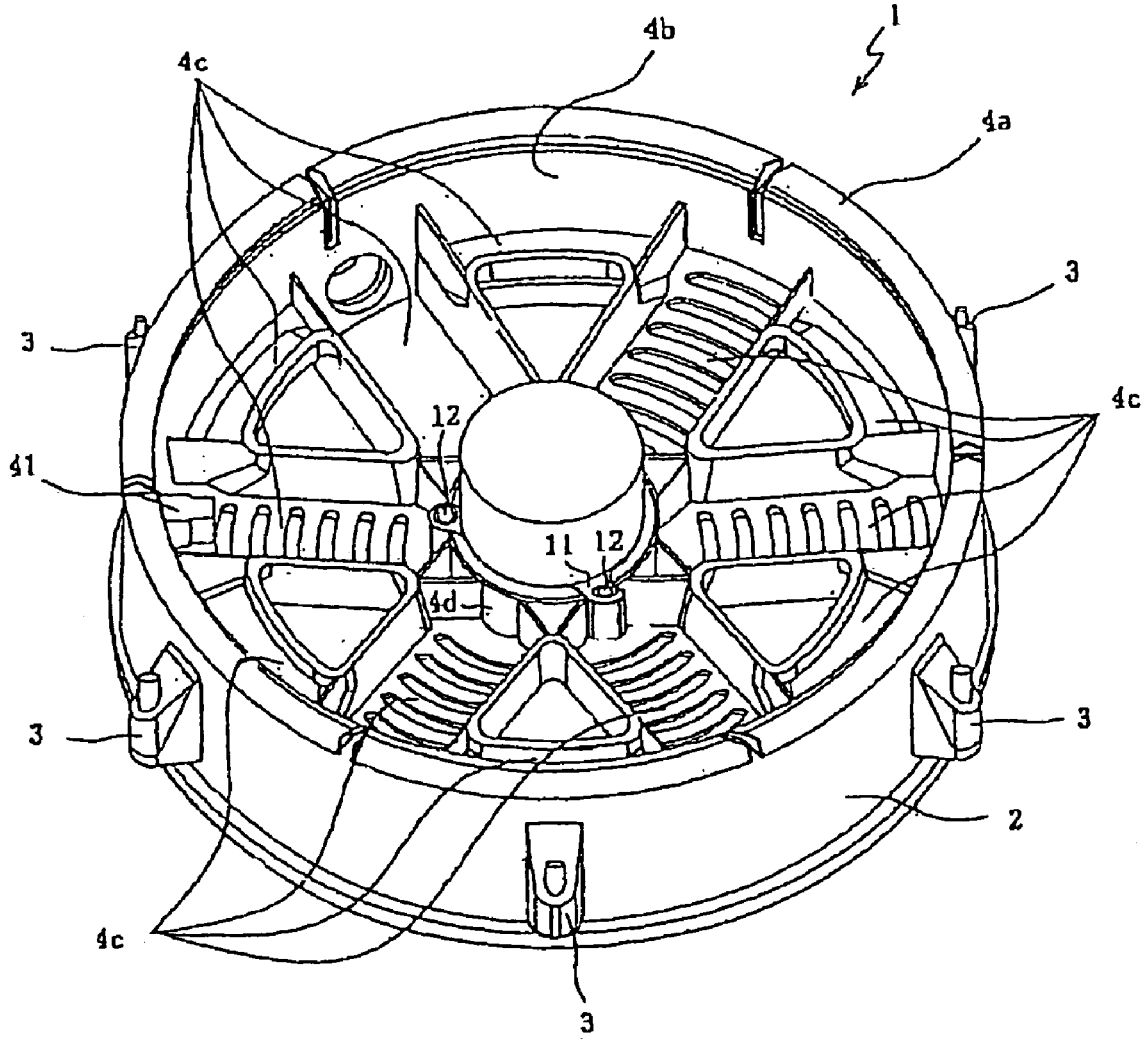
FIG. 7 is an oblique view of the electronic percussion instrument of the second preferred embodiment.
Figure 8:
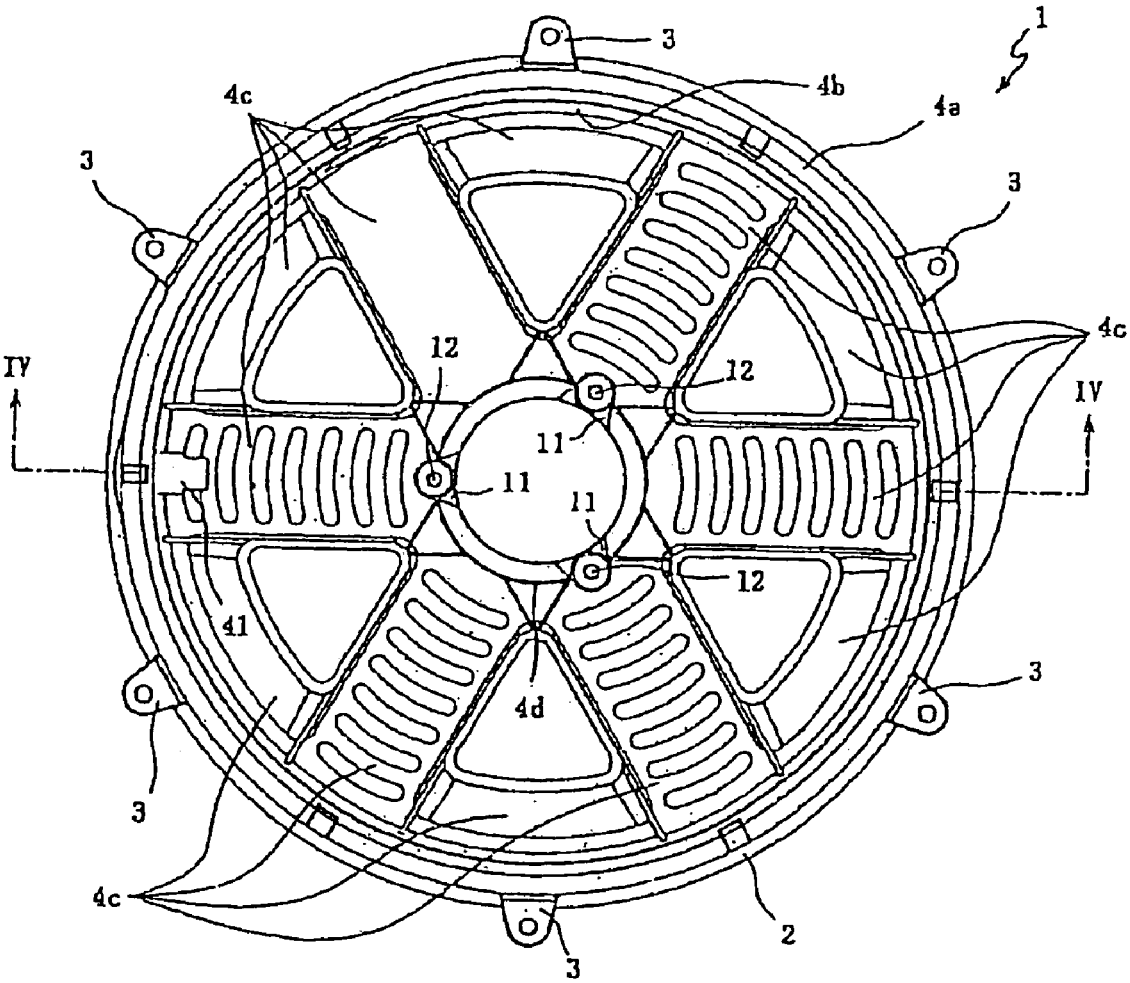
FIG. 8 is a front view of the electronic percussion instrument of the second preferred embodiment.
Figure 9:
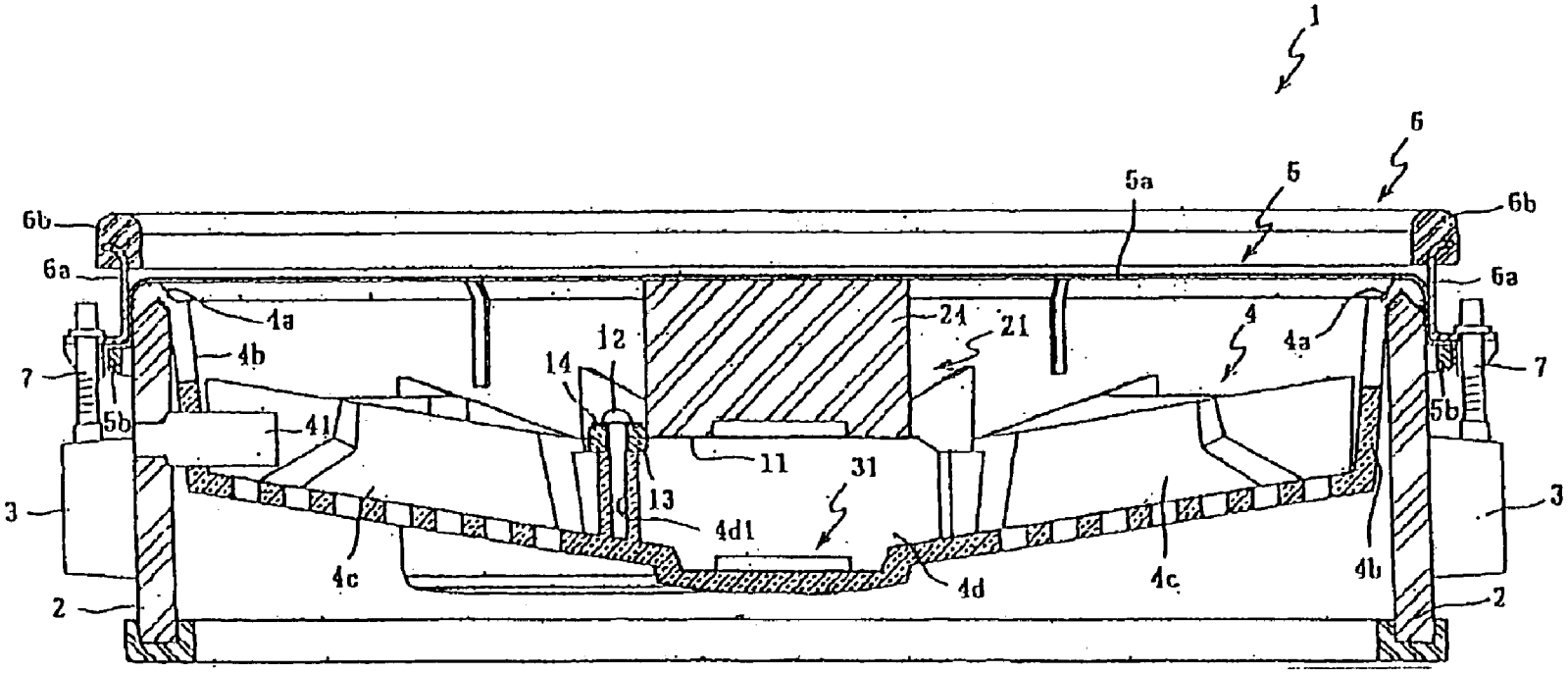
FIG. 9 is a cross-section drawing of the electronic percussion instrument of the second preferred embodiment along the line IV—IV of FIG. 8.

Further explanation regarding the head sensor 21 is provided with reference to FIGS. 5*a*–5*c*. FIG. 5*a* is a lateral surface drawing of the head sensor 21, FIG. 5*b* is an upper surface drawing of the head sensor 21 viewed from the direction of the arrow B of FIG. 5*a*, and FIG. 5*c* is a lower surface drawing of the head sensor 21 viewed from the direction of the arrow C of FIG. 5*a*. It is noted that FIGS. 5*a* through 5*c* omit portions of the output signal cable 22*a* of the piezoelectric element 22.

The head sensor 21 is comprised of a piezoelectric element 22. Double-sided tape with cushioning properties 23 is provided beneath the piezoelectric element, while a cushioning material 24 covers the piezoelectric element. The piezoelectric element 22 is a vibration detection sensor that transforms the vibrations into an electrical signal. As shown in FIGS. 5*b* and 5*c*, it is formed in a roughly circular plate shape that is furnished with an output signal cable 22*a*. The output signal cable 22*a* is connected to the output signal jack 41 (FIG. 4), and the electrical signal from the piezoelectric element 22 is output to a musical tone system (not shown) through the output signal jack 41.

The double-sided cushioning tape 23 that affixes the piezoelectric element 22 to the support plate 11 is comprised of adhesive layers laminated to the upper and lower surfaces of a cushioning layer. The double-sided tape is formed in a roughly circular plate shape similar to the shape of the piezoelectric element 22.

The cushioning material 24 transmits vibrations from the head 5 to the piezoelectric element 22. The cushioning material 24 is formed in a roughly cylindrical shape from an elastic material such as sponge or the like with a diameter that is larger than that of the piezoelectric element 22. The cushioning material 24 is configured with a concave space disposed in its bottom portion in which the piezoelectric element 22 is accommodated. The cushioning material 24 is positioned such that the upper surface of the cylindrical form is in contact with the lower surface of the head 5. In contrast to conventional trapezoidal shaped cushioning materials that taper as they approach the head, the cushioning material of the preferred embodiment maintains a broader area in contact with the head 5. This reduces variations in the strike sensitivity of the head sensor 21 and improves performance characteristics.

Referring to FIG. 4, the head sensor 21 is affixed to the support plate 11 by the double-sided cushioning tape 23 while the upper surface of the cushioning material 24 is held in contact with approximately the center location of the head 5. A vibration isolating damper 13 is attached between the support plate 11 and the sensor frame 4. The vibration isolation damper 13 is configured from an elastic material such as rubber, sponge, or the like, and is inserted into a hole in the end of the support plate 11. The center portion of the vibration isolating damper 13 has a penetrating hole disposed and drilled in it, and an attachment screw 12 is inserted through the hole. An attachment hole 4*d*1 having female screw threads is provided in the center section 4*d* of the sensor frame 4, and the attachment screw 12 is screwed into the attachment hole 4*d*1. As a result, the vibration isolating damper 13 is fixed to the sensor frame 4, and the support plate 11 is fixed indirectly to the sensor frame 4 through the vibration isolation damper 13.

A damper fixing member 14 is interposed between the attachment screw 12 and the vibration isolation damper 13.

The damper fixing member 14 has a roughly convex cross-section and is comprised of a metallic material or a resin material. The damper fixing member 14 has a height such that when the attachment screw 12 is screwed in the bottom surface of the damper fixing member 14 contacts the top surface of the attachment hole 4*d*1 while compressing the vibration isolation damper 13. This provides control over the compression of the vibration isolating damper 13, allowing vibration isolation to be adjusted.

Since the thickness of the vibration isolation damper 13 is made greater than the thickness of the support plate 11, the support plate 11 is prevented from contacting the sensor frame 4. As a result, vibrations from a rim shot that are transmitted from the rim 6 to the sensor frame 4 are absorbed by the vibration isolating damper 13, and since transmission to the support plate 11 is suppressed, erroneous detection of rim shot vibrations by the head sensor is reduced and performance characteristics are improved.

The rim shot sensor 31 is a sensor device for the detection of the vibration of the sensor frame 4 and, in the same manner as the head sensor 21, is a piezoelectric element and is configured as a vibration detection sensor furnished primarily with double-sided tape with cushioning properties for affixing the piezoelectric element to the sensor frame 4. The configuration of the piezoelectric element and the double-sided cushioning tape are essentially the same as for the head sensor 21, and so detailed explanation is omitted.

The rim shot sensor 31 is affixed to the upper surface of the sensor frame 4 by double-sided cushioning tape. The rim shot sensor 31 is isolated from the outside of the instrument, making it possible to prevent the rim shot sensor 31 from being damaged or dislodged during transporting or setting up of the electronic percussion instrument 1.

The rim shot sensor 31 is affixed at the approximate center of the sensor frame 4 at the center section 4*d*. As such, the distance of the rim shot sensor 31 to any portion of the flange section 4*a* is roughly equal. As a result, it is possible to make the striking sensitivity distribution of the rim shot sensor 31 nearly uniform and to improve rim shot performance.

In the electronic percussion instrument of the preferred embodiment, the flange 4*a* is disposed on the outer periphery of the sensor frame 4 the flange 4*a* engages the upper peripheral edge of the body section 2, allowing attachment of the sensor frame 4 to the body section 2 to be simplified. In addition, the structure of the sensor frame 4 and the body section 2 are simplified, reducing component costs and structural costs.

In addition, the flange 4*a* of the sensor frame 4 contacts the upper peripheral edge of the body section 2 roughly uniformly over the entire periphery. Therefore, even in those cases where the rim 6 is struck at any location in the peripheral direction, the transmission of the vibrations from the rim 6 to the rim shot sensor 31 is nearly uniform. This reduces variations in the strike sensitivity of the rim shot sensor and improves rim shot performance.

FIGS. 6–9 show features of a second preferred embodiment. This embodiment differs from the first preferred embodiment in two respects. The flange 4*a* of the sensor frame 4 has a concave lower surface for engaging a convex upper peripheral edge surface of the body section 2. These complimentary surfaces provide accurate seating of the sensor frame 4 within the body section 2 and oppose deformation of the sensor frame 4 with respect to the body section 2 when the sensor frame 4 is tightened to the body portion 2. The sensor frame 4 of the second preferred embodiment also has slits formed at regular intervals through the flange 4*a* and extending into the sidewall 4*b*. The slits provide a degree of flexibility in the flange 4*a* and sidewall 4*b* of the sensor frame 4 that enables the sensor frame 4 to be more accurately fitted to and seated against the body section 2. The views provided in FIGS. 6, 7, 8 and 9 are similar to those of FIGS. 1, 2, 3 and 4, and show the structure and location of these features in the second preferred embodiment.

While the embodiments described herein are currently preferred, the present invention is not in any way limited to the preferred embodiments described above and the possibility of various modifications and changes that do not depart from purport and are within the scope of the present invention can be easily surmised.

For example, the vibration detection sensors may have forms that differ from those of the sensors 21 and 31 of this preferred embodiment and may be attached in locations that differ from those of the preferred embodiment. Further, in the preferred embodiment, the structural elements of the electronic percussion instrument 1 comprise the head sensor 21, the rim shot sensor 31 and the sensor frame 4. However, the invention is not limited to this structure and, for example, the head sensor 21, the rim shot sensor 31, and the sensor frame 4 can be made as a unit, or either one or both of the sensors 21 and 31 and the sensor frame can be made as a unit and this may comprise the vibration detection apparatus.

The vibration detection apparatus that has been made into a unit in this manner can be installed in the body section of an existing acoustic drum or other kind of percussion instrument, allowing an electronic percussion instrument that is in line with the preferences of the performer to be easily configured.

Since, in accordance with the present invention, the configuration is such that the outer peripheral section of the frame engages the upper peripheral edge of the body of the electronic percussion instrument, the frame can be easily attached to the body. Therefore, the use of screws or the like is not required when the frame is mounted on the body, and the frame structure can be simplified. Thus it is possible to reduce the structural cost of the frame and to reduce the cost of attachment to the body.

In addition, strike sensitivity distribution for the rim shot sensor is nearly uniform. As a result, rim shots may be detected stably by the rim shot sensor without regard to the location of the striking, thus improving rim shot performance characteristics.

What is claimed is:

1. A vibration detection apparatus for an electronic percussion instrument for detecting vibrations caused by striking of the electronic percussion instrument, comprising:

a frame comprising:

an outer peripheral section for engaging a top rim of a body of the electronic percussion instrument;

a center section arranged at the approximate center of the outer peripheral section; and a linking section surrounding the center section and extending from the center section toward the outer peripheral section to link the center section with the outer peripheral section; and a rim shot sensor arranged at the center section of the frame for detecting vibrations of the frame;

wherein the outer peripheral section of the frame comprises a flange and a plurality of slits extending through the flange and into a sidewall of the outer peripheral section.

2. The vibration detection apparatus claimed in claim 1 wherein the flange has a lower concave surface for engaging a convex surface of the top rim of the body.

3. The vibration detection apparatus claimed in claim 1, wherein the linking section is comprised of at least three arms that extend between the center section and the outer peripheral section and are approximately equally spaced around the center section.

4. The vibration detection apparatus claimed in claim 3, wherein the arms have an approximately U-shaped cross-section.

5. The vibration detection apparatus claimed in claim 3, wherein the arms are provided with a plurality of openings.

6. The vibration detection apparatus claimed in claim 1, wherein the linking section is provided with a plurality of openings.

7. The vibration detection apparatus claimed in claim 1, wherein the rim shot sensor is affixed to the center section of the frame by double-sided cushioning tape.

8. The vibration detection apparatus claimed in claim 1, further comprising a head sensor supported by the frame at an approximate center of the frame.

9. The vibration detection apparatus claimed in claim 8, further comprising a cushioning material arranged above the head sensor for engaging a head of the electronic percussion instrument to transmit vibrations of the head to the head sensor.

10. The vibration detection apparatus claimed in claim 8, wherein the head sensor is mounted on a support plate that is coupled to the frame through a vibration isolating damper.

11. The vibration detection apparatus claimed in claim 10, wherein the head sensor is affixed to the center section of the frame by double-sided cushioning tape.

12. A vibration detection apparatus for an electronic percussion instrument for detecting vibrations caused by striking of the electronic percussion instrument, comprising:

a frame comprising:

an outer peripheral section for engaging a top rim of a body of the electronic percussion instrument;

a center section arranged at the approximate center of the outer peripheral section; and a linking section surrounding the center section and extending from the center section toward the outer peripheral section to link the center section with the outer peripheral section;

a head sensor supported by the frame at an approximate center of the frame; and a cushioning material arranged above the head sensor for engaging a head of the electronic percussion instrument to transmit vibrations of the head to the head sensor;

wherein the outer peripheral section of the frame comprises a flange and a plurality of slits extending through the flange and into a sidewall of the outer peripheral section.

13. The vibration detection apparatus claimed in claim 12, wherein the flange has a lower concave surface for engaging a convex surface of the top rim of the body.

14. The vibration detection apparatus claimed in claim 12, wherein the linking section is comprised of at least three arms that extend between the center section and the outer peripheral section and are approximately equally spaced around the center section.

15. The vibration detection apparatus claimed in claim 14, wherein the arms have an approximately U-shaped cross-section.

16. The vibration detection apparatus claimed in claim 14, wherein the arms are provided with a plurality of openings.

17. The vibration detection apparatus claimed in claim 12, wherein the linking section is provided with a plurality of openings.

18. The vibration detection apparatus claimed in claim 12, wherein the head sensor is mounted on a support plate that is coupled to the frame through a vibration isolating damper.

19. The vibration detection apparatus claimed in claim 18, wherein the head sensor is affixed to the support plate by double-sided cushioning tape.

20. An electronic percussion instrument comprising:

a hollow cylindrical body;

a frame arranged within the body and having an outer peripheral section engaging an end portion of the body, a center section that is arranged at an approximate center of the body, and a linking section surrounding the center section and extending from the center section toward the outer peripheral rim to link the center section with the outer peripheral rim;

a rim shot sensor arranged in the center section of the frame for detecting the vibrations of the frame;

a head arranged as a striking surface at the end portion of the body;

a head sensor supported by the frame at an approximate center of the frame;

a cushioning material arranged between the head and the head sensor for transmitting vibrations of the head to the head sensor; and a rim engaging the body to hold the outer peripheral section of the frame and the head between the rim and the end portion of the body and to impart tension to the head;

wherein the outer peripheral section of the frame comprises a flange and a plurality of slits extending through the flange and into a sidewall of the outer peripheral section.

21. The electronic percussion instrument claimed in claim 20, wherein the flange has a lower concave surface for engaging a convex surface of the top rim of the body.

22. The electronic percussion instrument claimed in claim 20, wherein the linking section is comprised of at least three arms that extend between the center section and the outer peripheral section and are approximately equally spaced around the center section.

23. The electronic percussion instrument claimed in claim 22, wherein the arms have an approximately U-shaped cross-section.

24. The electronic percussion instrument claimed in claim 22, wherein the arms are provided with a plurality of openings.

25. The electronic percussion instrument claimed in claim 20, wherein the linking section is provided with a plurality of openings.

26. The electronic percussion instrument claimed in claim 20, wherein the rim shot sensor is affixed to the center section of the frame by double-sided cushioning tape.

27. The electronic percussion instrument claimed in claim 20, wherein the head sensor is mounted on a support plate that is coupled to the frame through a vibration isolating damper.

28. The electronic percussion instrument claimed in claim 27, wherein the head sensor is affixed to the support plate by double-sided cushioning tape.

29. The electronic percussion instrument claimed in claim 20, wherein the rim comprises retaining bolts that are coupled to retaining sections on the body for engaging the rim to the body.

* * * * *